US008464467B2

(12) United States Patent
Lambertini

(10) Patent No.: US 8,464,467 B2
(45) Date of Patent: Jun. 18, 2013

(54) SASH FOR SLIDING DOOR OR WINDOW

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 20 days.

(21) Appl. No.: 13/148,713

(22) PCT Filed: Feb. 26, 2010

(86) PCT No.: PCT/IB2010/050844

§ 371 (c)(1),
(2), (4) Date: Aug. 10, 2011

(87) PCT Pub. No.: WO2010/097776

PCT Pub. Date: Sep. 2, 2010

(65) Prior Publication Data

US 2011/0308169 A1 Dec. 22, 2011

(30) Foreign Application Priority Data

Feb. 26, 2009 (IT) ..... BO2009A0112

(51) Int. Cl.
*E06B 7/28* (2006.01)

(52) U.S. Cl.
USPC ..... 49/321; 49/316; 49/317; 49/318

(58) Field of Classification Search
USPC ..... 49/316, 317, 318, 319, 320, 321
See application file for complete search history.

(56) References Cited

U.S. PATENT DOCUMENTS

| | | | | |
|---|---|---|---|---|
| 2,763,038 | A * | 9/1956 | Hagerty et al. | 49/390 |
| 2,971,228 | A * | 2/1961 | Szabo | 49/209 |
| 3,374,821 | A * | 3/1968 | White | 160/40 |
| 3,425,163 | A | 2/1969 | Horgan, Jr. | |
| 4,656,779 | A * | 4/1987 | Fedeli | 49/318 |
| 5,471,791 | A * | 12/1995 | Keller | 49/317 |
| 5,481,834 | A * | 1/1996 | Kowalczyk et al. | 52/64 |
| 5,577,348 | A * | 11/1996 | Keller | 49/317 |
| 6,112,466 | A * | 9/2000 | Smith et al. | 49/306 |
| 7,124,538 | B1 * | 10/2006 | Kline | 49/316 |
| 7,685,775 | B2 * | 3/2010 | Speyer et al. | 49/411 |
| 7,685,776 | B2 * | 3/2010 | Speyer et al. | 49/411 |
| 8,033,068 | B2 * | 10/2011 | Luttmann et al. | 52/243.1 |
| 8,074,399 | B2 * | 12/2011 | Speyer et al. | 49/318 |

FOREIGN PATENT DOCUMENTS

| | | |
|---|---|---|
| DE | 89 04 622 U1 | 6/1989 |
| DE | 298 12 574 U1 | 11/1998 |
| DE | 297 24 242 U1 | 9/2000 |
| EP | 1 344 888 A1 | 9/2003 |
| NL | 7 206 982 A | 12/1972 |

* cited by examiner

*Primary Examiner* — Jerry Redman

(74) *Attorney, Agent, or Firm* — Pearne & Gordon LLP

(57) ABSTRACT

A sash for sliding doors or windows includes: a main body (1) including an insulating chamber (2) located between respective glazing panels (3, 4) whose dimensions are larger than the dimensions of the chamber, so as to form a perimetric housing (5) which is open towards the outside; three rigid profiles (6) forming a frame inside three respective sides of the main body being stably accommodated in the housing; the rigid profiles forming an accessory zone, open to the outside; the three rigid profiles each forming a channel (11) accommodating a rod (8) for operating elements which drive and/or open and close the sash (100); the three rigid profiles forming one upright (103) and two crosspieces (6*m*, 105) of the sash; the ends of the profiles are joined by an angled element (12), so that the channel (11) runs uninterruptedly along the three sides of the main body.

18 Claims, 15 Drawing Sheets

SASH FOR SLIDING DOOR OR WINDOW

TECHNICAL FIELD

This invention relates to a sash for a sliding door or window, in particular a sash which can slide on at least one track between an open position and a closed position.

BACKGROUND ART

Sliding doors and windows of the traditional or lift and slide type are well known, and basically comprise:

- a fixed frame;
- at least one mobile frame or sash which slides horizontally, opening and closing relative to the fixed frame;
- at least one sliding unit or carriage associated with the bottom crosspiece of the sash and resting on a horizontal base track and designed to enable the sash to slide in both directions;
- a control element located on the mobile frame and designed to actuate operating means which can be used to move closing means and to disengage the sash from the fixed frame so that it can be slid open, and, vice versa, when the upright of the sash is in contact with the upright of the fixed frame to stop the sash in a closed positioned;
- the closing means therefore acting at least between the upright of the sash and the upright of the fixed frame (which, in the closed configuration are abutted against each other edge to edge).

In the case of a lift and slide sliding door or window, the operating means allow disengagement of the closing means together with lifting of the sash relative to the carriage (so as to move weather strips located on the sash away from the track) and lowering of the sash at the sash closed position in order to return the weather strips to the position where they seal the door or window.

Current basic structures of a sliding sash for doors or windows combine a frame made of metal or synthetic material for perimetric closing of glazing with an inner insulating chamber.

The sash frame normally comprises four sectors (forming the two uprights and the two crosspieces) fixed together and on which the glazing is applied (having a flat perimetric profile).

The respective ends of the stretches of the frame are usually cut at 45° so that they can be joined (by special, known inner corner devices) to the corresponding end of the contiguous stretch.

Once this frame is complete, a set of machining operations is performed on it (cutting, slotting, boring, recessing, etc.) to create the housings or suitable passages for:

- the control elements, that is to say, the handle,
- closing means (catches or housings for them),
- insertion of transmission means,
- sliding carriages, and
- stretches of operating rod for insertion in special channels.

Therefore, a sash structured in this way may not just have a significant overall weight, but also an appearance that is not always acceptable due to the presence of the visible outer frame (depending on the rooms where it is installed) and high production costs, in particular due to the machining necessary for application of accessory elements which are essential for its movement and closing.

DISCLOSURE OF THE INVENTION

This invention therefore has for an aim to overcome these disadvantages by providing a sash for sliding doors or windows that is extremely rational, has reduced overall weight, with improved thermal performance, lower production costs, but that is still as reliable and secure as a conventional sash.

This invention also has for an aim to obtain a sash with improved appearance compared with conventional sashes and which can also be used on all-glass building structures called "curtain walls".

Yet another aim is to obtain a sash that is easy to assemble and has structural continuity as regards both the seal and the maneuverability of the control and sliding elements, such as carriages in lift and slide sashes.

These aims are achieved by a sash in which the main body for the glazing forms a perimetric housing open towards the outside engaging with rigid profiles forming a frame inside the main body.

Three of these rigid profiles form a zone, open towards the outside, equipped with accessories and in which means for operating and/or driving the main body in use are housed and/or are slidable.

In that way a completely glazed outer surface is obtained.

Each of the three rigid profiles comprises three parts, of which two are sides whose geometry is adaptable to the housing and one is a central head portion comprising a first sealing or insulating element bilaterally associated with the two sides and forming the innermost surface in the housing.

This increases the sash inner/outer thermal seal.

Moreover, the three rigid profiles each form a channel which in use houses an operating rod for the main and accessory elements (for example, handle and carriages) for driving and/or opening and closing the sash in use.

The channel extends parallel with the first insulating element and close to said element which insulates it from the sash insulating chamber above.

A rigid profile associated with the interior of the housing of the main body forming the sash bottom crosspiece houses a pair of sliding carriages, which are partly inserted in the channel and can be connected to the operating rod, the carriages slidably supporting the main body in use.

In this way, "hidden" housing can be obtained for the carriages, without changing the outer appearance of the sash, connecting the carriages to the main operating elements, by means of the rod, to perform the coordinated opening and closing operating movements if necessary (for example, in doors or windows of the "lift and slide" type).

In addition, each of the three rigid profiles forming one upright and two crosspieces of the sash, has its contiguous ends angled in such a way that they can be joined and form a continuous cover for the corner of the frame.

The ends of the profiles are joined by an angled element associated with the corresponding innermost surfaces of the contiguous profiles so that the channel runs uninterruptedly along the three sides.

This allows a secure connection along the three sides between the various control, operating and sliding elements on the sash.

Advantageously, the angled element may be associated in the profile by housing it in a tubular housing present in the first sealing element: in this way the dimensions are reduced and the contact surfaces between the metal elements are interrupted, thus keeping the sash thermal seal coefficient high.

BRIEF DESCRIPTION OF THE DRAWINGS

Accordingly, this invention achieves this aim with a sash for doors or windows, in particular a sash for sliding doors or windows comprising the technical features set out in one or more of the appended claims and the technical features of the invention, with reference to the above aims, are clearly described in the claims below and its advantages are more apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
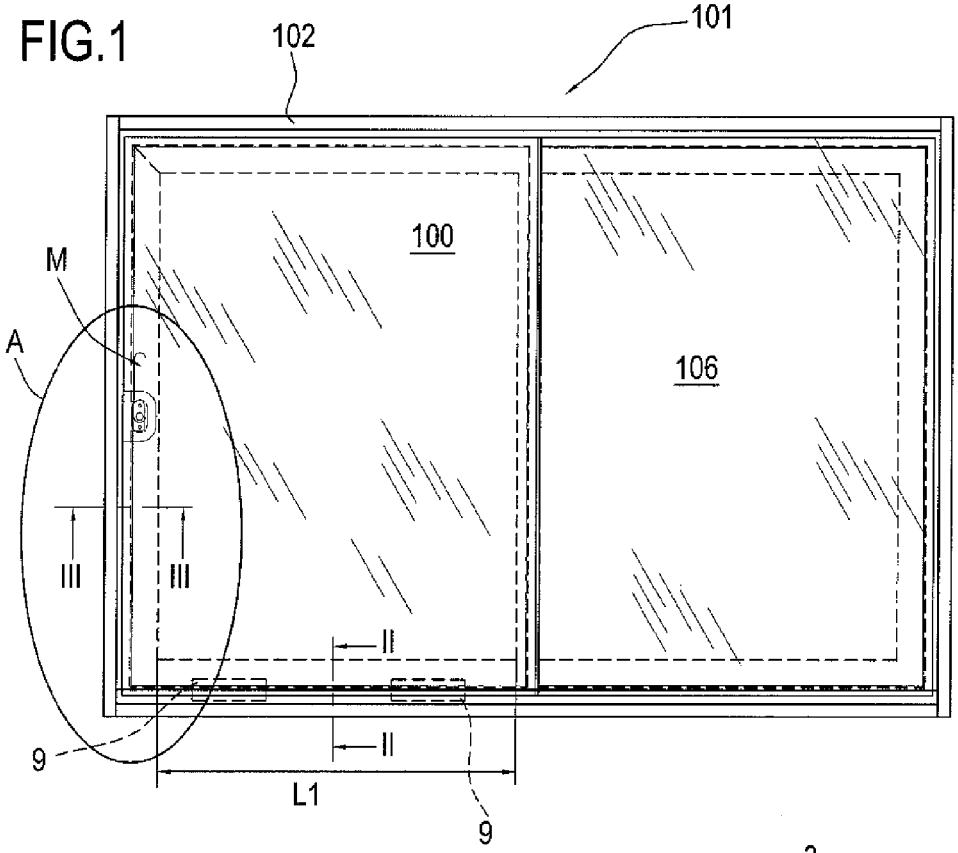
FIG. 1 is a schematic front view, with some parts cut away in order to better illustrate others, of a sash for sliding doors or windows according to this invention.

With reference to the accompanying drawings, and in particular FIG. 1, the sash according to the invention, labelled 100 in its entirety, may be used for sliding doors, windows or French windows.

This door or window, labelled 101, may comprise, for example, a fixed frame 102, at least one mobile frame or sash 100, one or a pair of carriages 9 and at least one control element M (a handle described in more detail below).

More specifically, the sash 100 is slidable relative to the fixed frame 102 between a closed position (see FIG. 1) and an open position (not illustrated).

In more detail, the sash 100 is slidable horizontally along a fixed track 105 positioned at the base of the fixed frame 101 and, in its fully open position (not illustrated), can (purely by way of example) be superposed over a fixed sash 106 or a sash that is also mobile, opening in the opposite direction to the first sash.

Figure 4:
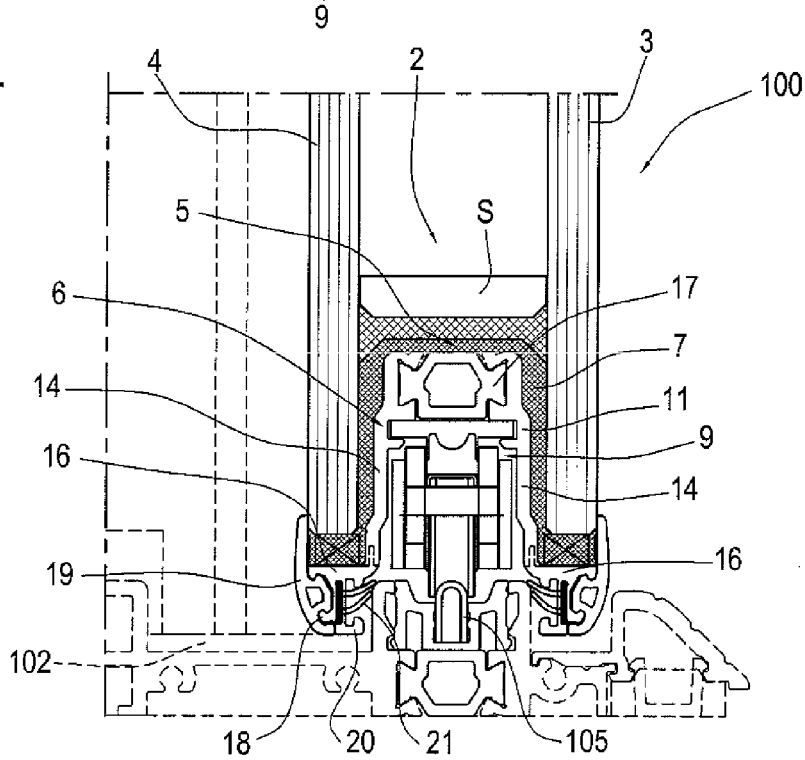
FIG. 4 shows an alternative embodiment of FIG. 2 in which operating and sliding elements are applied along a crosspiece of the sash according to the invention.
Figure 15:
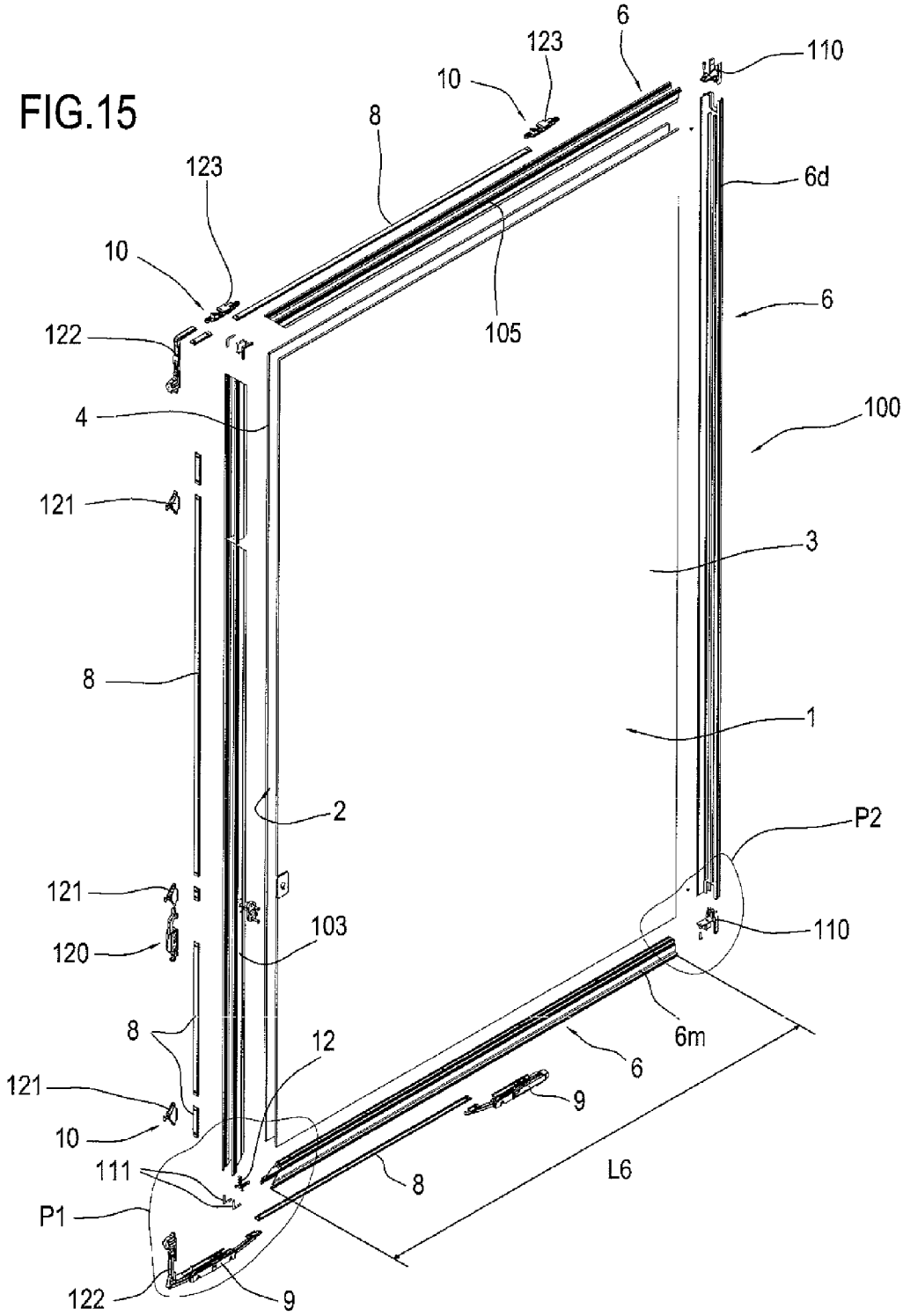
FIG. 15 is an exploded perspective view of a sliding sash in accordance with this invention.
Figure 16:
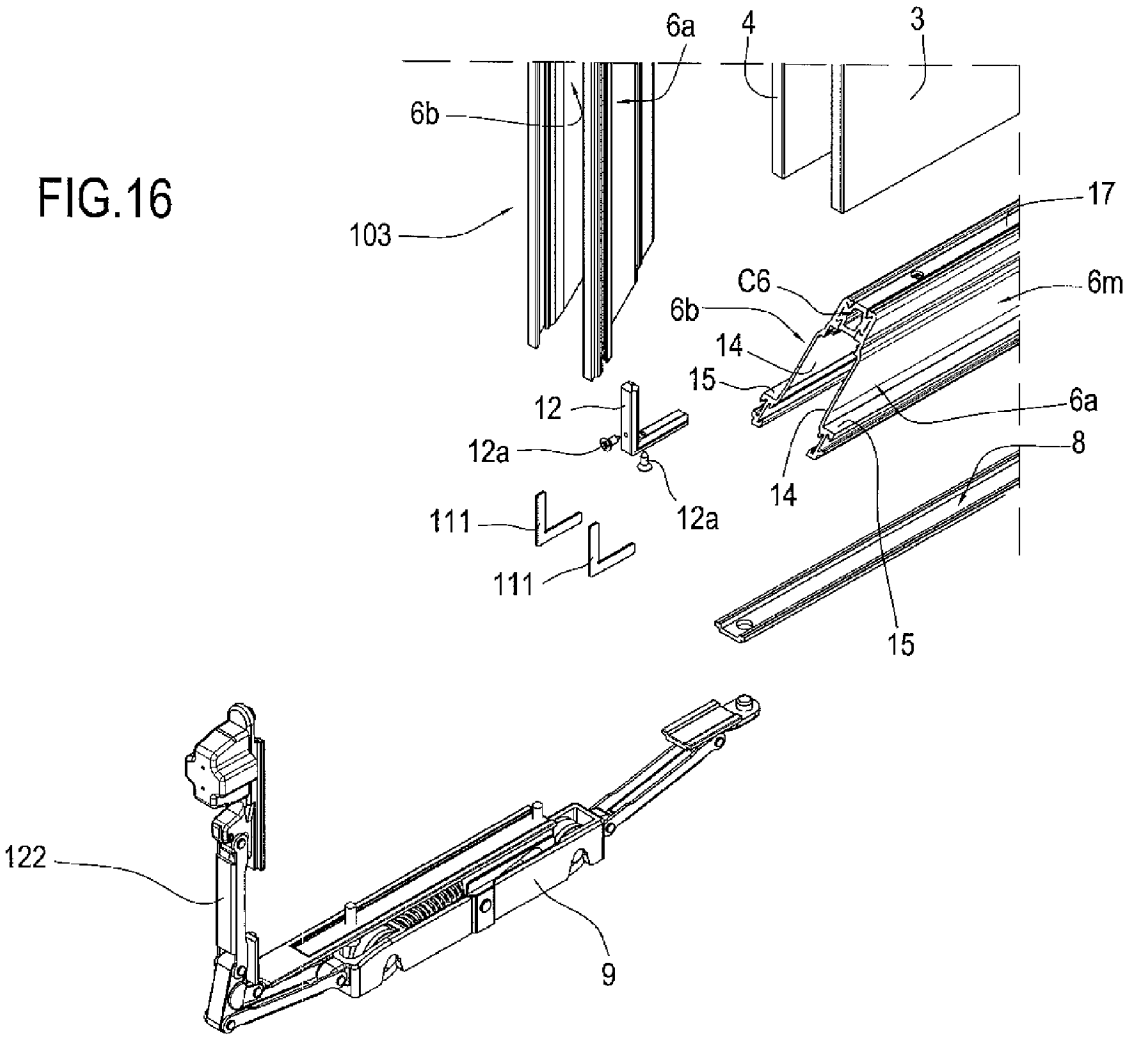
FIG. 16 illustrates an enlarged detail P1 from FIG. 15.

FIG. 1 schematically illustrates, again by way of example and without limiting the scope of the invention, a pair of carriages 9, each of which is associated with the bottom crosspiece of the sash 100 and is guided by the track 105 to enable the sash 100 to slide to and from the above-mentioned open and closed positions (an example of a carriage 9 is illustrated in FIGS. 4, 15 and 16).

The individual sash 100, of particular interest in this text, will be described singly for the sake of simplicity, without thereby limiting the invention even to two sashes in the same door or window having the same characteristics. The sash 100 basically comprises:

- a main body 1 comprising an insulating chamber 2 bilaterally obtained from respective glazing panels 3, 4 whose dimensions are larger than the dimensions of the chamber 2 so as to form a perimetric housing 5 open towards the outside; and
- a rigid profile 6, forming a frame inside the main body 1, for each side of the main body 1 itself and designed to be accommodated stably in each housing 5 through respective fastening means 7.

On at least three sides of the main body 1 there are corresponding rigid profiles 6 forming a zone, open towards the outside, equipped with accessories and in which means 8, 9, 10 for operating and/or driving the main body 1 in use are housed and/or are slidable.

Obviously, the three profiles 6 are those positioned on the sides forming the front upright on which the handle M is applied and the two crosspieces, bottom and top, whilst the rear upright may even be without the zone equipped with accessories.

The insulating chamber 2, of the known type, is obtained in the known way by interposing between the glazing panels 3 and 4 an insulating shim S with suitable adhesive or structural silicone so as to obtain "double-glazing".

Figure 2:
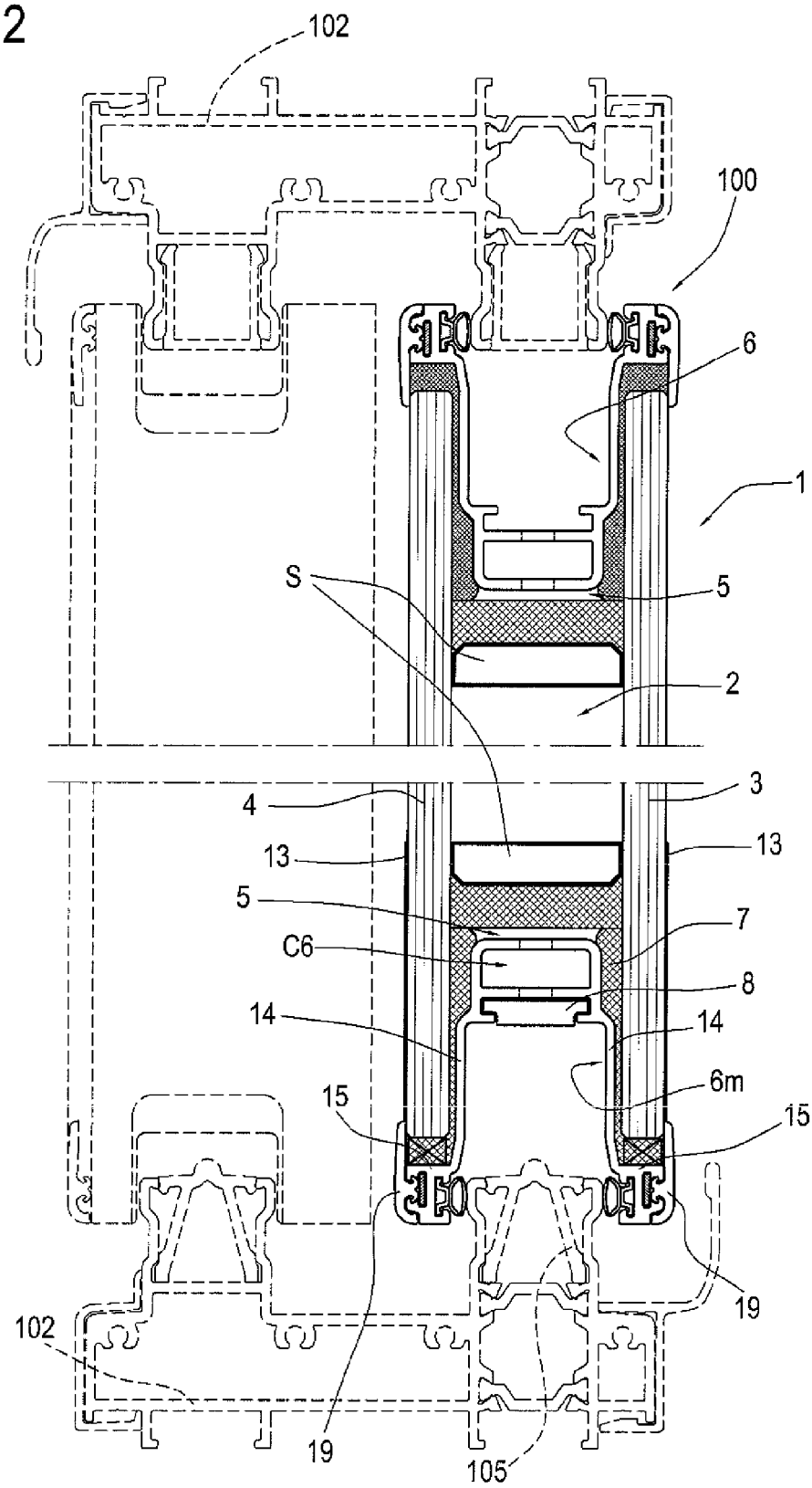
FIG. 2 is a cross-section according to the line II-II of FIG. 1 with some parts cut away to better illustrate others.
Figure 3:
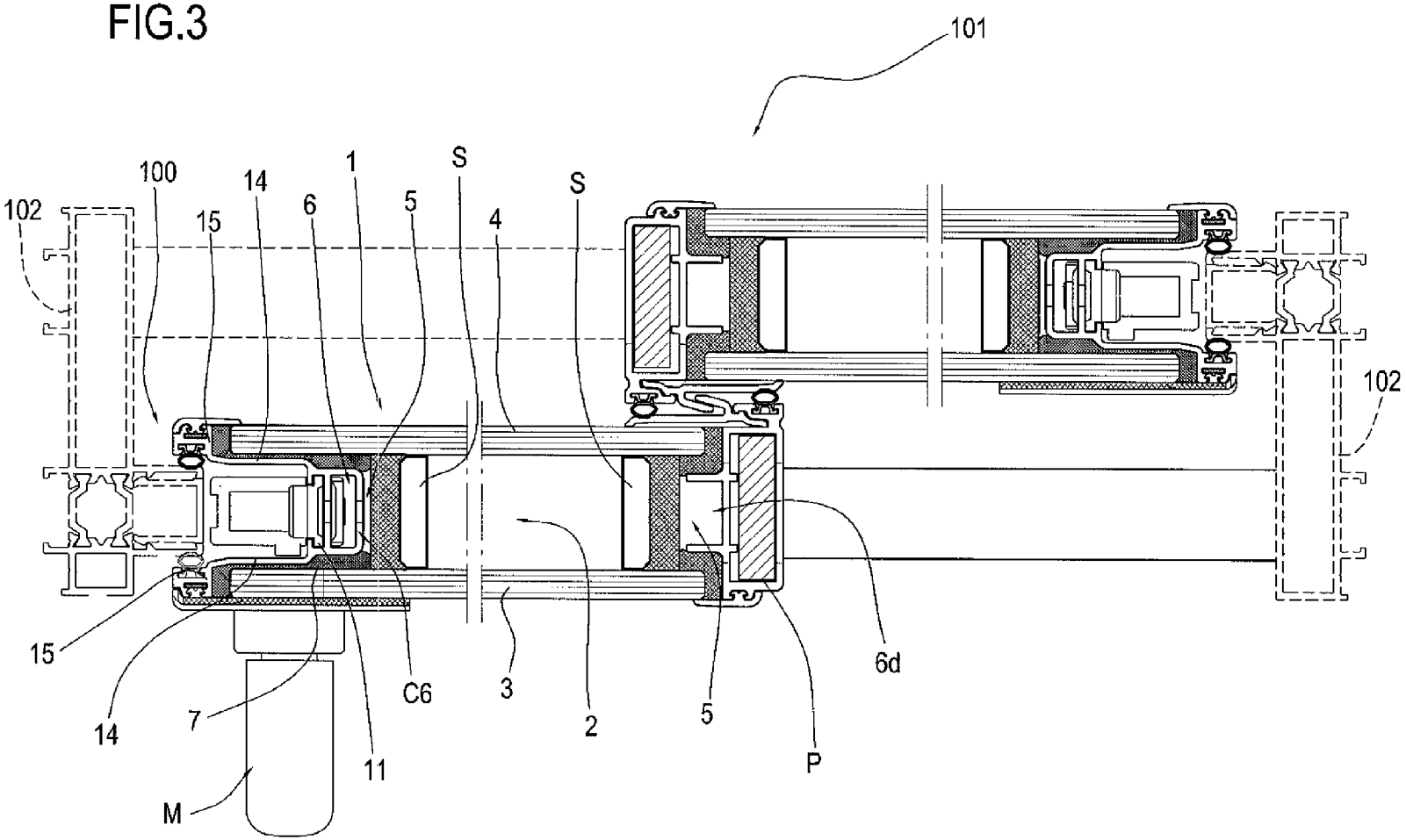
FIG. 3 is a cross-section according to the line III-III of FIG. 1 with some parts cut away to better illustrate others.

As can also be seen in FIGS. 2 and 3, the above-mentioned rigid profiles 6 or, as indicated, also the fourth profile 6 each form at least one channel 11 in which part of the means 8, 9, 10 for operating and/or driving the main body 1 in use can be housed and/or slide.

At a structural level, and in a first construction solution illustrated in FIGS. 1 to 6 and 11 to 14, each rigid profile 6 has a length L6 which is substantially equal to the total length L1 of the respective side of the main body 1.

As illustrated in FIGS. 4, 6, 8, 10, from 11 to 14 and 16 and 17, the three above-mentioned rigid profiles comprise three parts, of which two are sides 6*a* and 6*b* whose geometry is adaptable to the housing 5, internally forming an accessory zone, and one is a central portion comprising a first sealing insulating element 17 that is bilaterally associated with the two sides 6*a* and 6*b* and forms the innermost profile zone in the housing 5.

The accessory zone of these three rigid profiles 6 is formed, for each profile, by at least one channel 11 which in use accommodates at least one rod 8 for operating main means 9 and accessory means 10 which drive and/or open and close the sash 100 in use.

As the Figures referred to clearly show, this channel 11 is obtained close to the first insulating element 17, thus separating the accessory zone from the innermost contact points in the chamber 2, to maintain a good sash 100 perimetric thermal seal.

FIGS. 4, 15 and 16 show how a rigid profile 6*m* forms a bottom crosspiece of the sash 100 which accommodates the pair of sliding carriages 9, which are partly inserted in the channel 11 and can be connected to the operating rod 8, thus in use slidably supporting the main body 1, that is to say, the sash 100 in its entirety.

Figure 11:
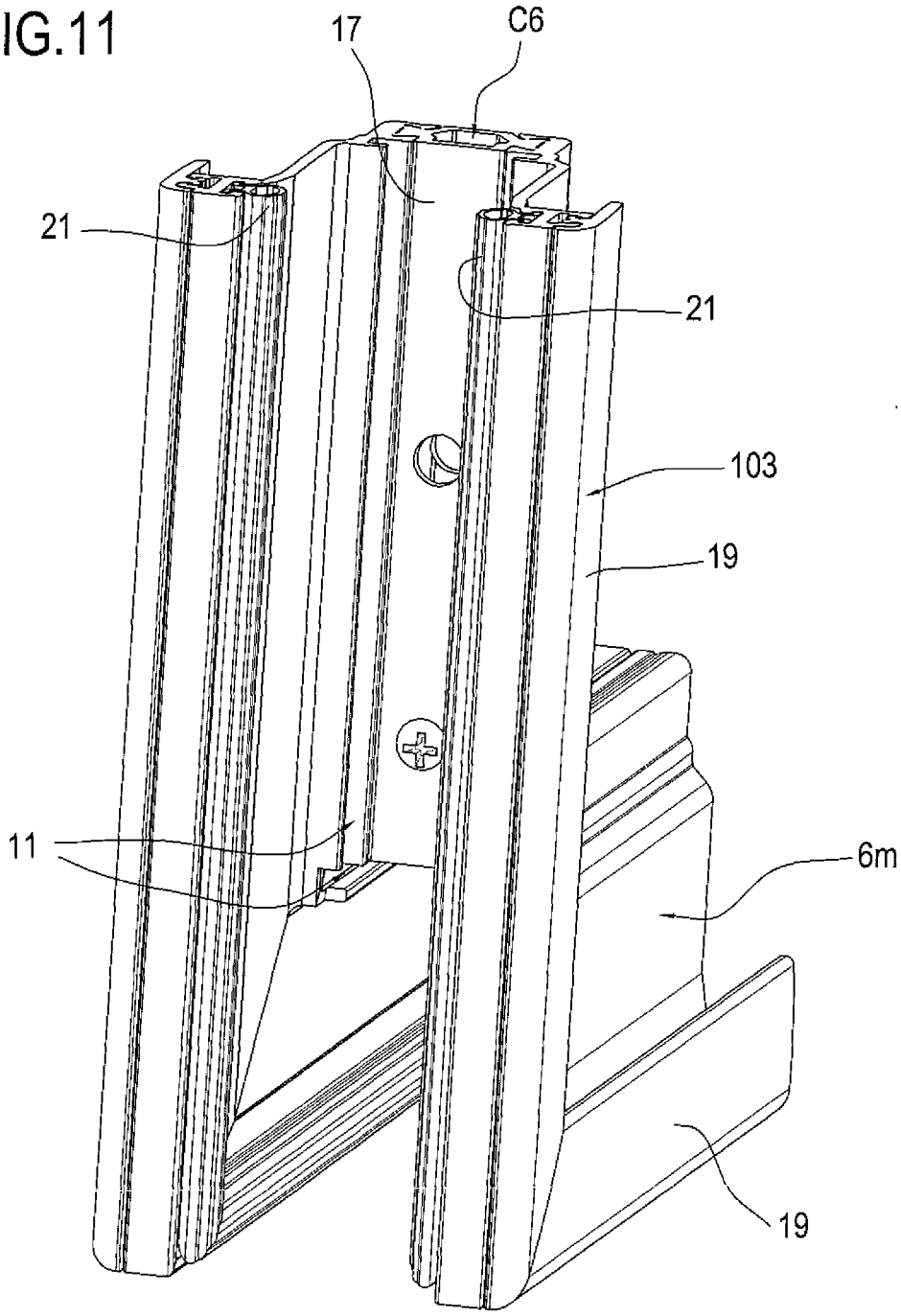
FIGS. 11 and 12 are respectively a perspective view and an exploded perspective view of a portion of the sash according to the invention, in particular a first bottom corner zone of the sash which is respectively assembled and being assembled.
Figure 12:
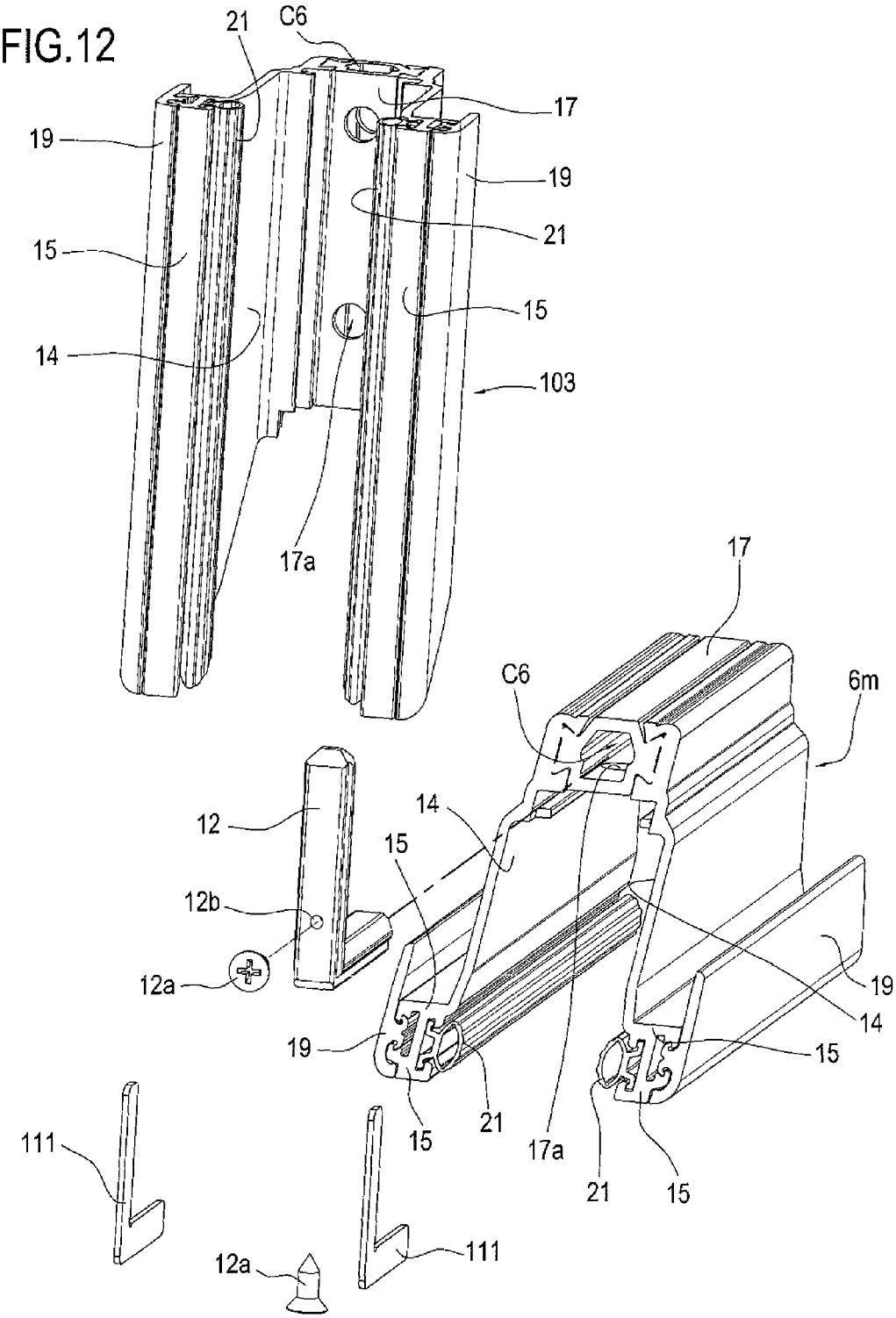

As regards the system for joining the rigid profiles 6, in particular those forming a front upright 103 and the two crosspieces 6*m* and 105 of the sash 100, these profiles have contiguous ends shaped so that they are angled, allowing them to be joined and to form a continuous cover for the corner of the frame (see in particular FIGS. 11, 12 and 16).

These ends of the profiles 6 are joined by an angled element or bracket 12 associated with the corresponding innermost surfaces of the contiguous profiles 6 so that the channel 11 also runs uninterruptedly along the three sides.

Therefore, in this embodiment the rigid profile 6 forming the inner frame of the sash 100 front upright 103 has the two ends shaped, that is to say, angled, at an angle $\alpha$ equal to 45° so that it connects with the corresponding ends of each of the profiles 6*m* and 105 forming the top and bottom crosspieces, which also have the same angled shape.

Therefore, basically, each contiguous end of the three profiles 6 is set at a 45° angle to obtain an angled plane for contact with the contiguous angled plane of the corresponding profile 6 and, in use, to form a right angle of the frame (see FIGS. 11 and 16).

These corner zones are also joined by the above-mentioned first insulating element 17 (substantially a seal) forming the profile 6.

This first insulating element 17 comprises a central tubular housing C6 which can accommodate, during assembly, the angled element 12 used to join the profiles 6.

The angled element 12 comprises threaded housings 12*b*, whilst the first insulating element 17, in the corner zone, comprises through holes 17*a* (see FIG. 12).

After inserting the stretch of the angled element 12 in the tubular housing C6, a screw 12*a* is passed, from the outside of the profile 6, into the through hole 17*a* and tightened in the housing 12*b* of the angled element 12 to stably join the angled element 12 to the profile 6 by contact with the inner part of the first insulating element 17.

This allows the interruption of inner contact between metal element which could create a heat bridge, but at the same time provides precise, easy and rapid joining of the profiles 6.

Moreover, use of the tubular housing C6 for the join allows the accessory zone working spaces to remain unchanged, including the channel 11 of the profiles 6.

In contrast, the two profiles 6*m* and 105 have the opposite ends shaped like a right angle for coupling with the fourth profile 6*d* which forms the rear upright, which is also shaped like a right angle: this is simply for structural reasons, due to the absence, in the rear part and in this non-limiting embodiment, of transmission and operating or closing elements.

Figure 13:
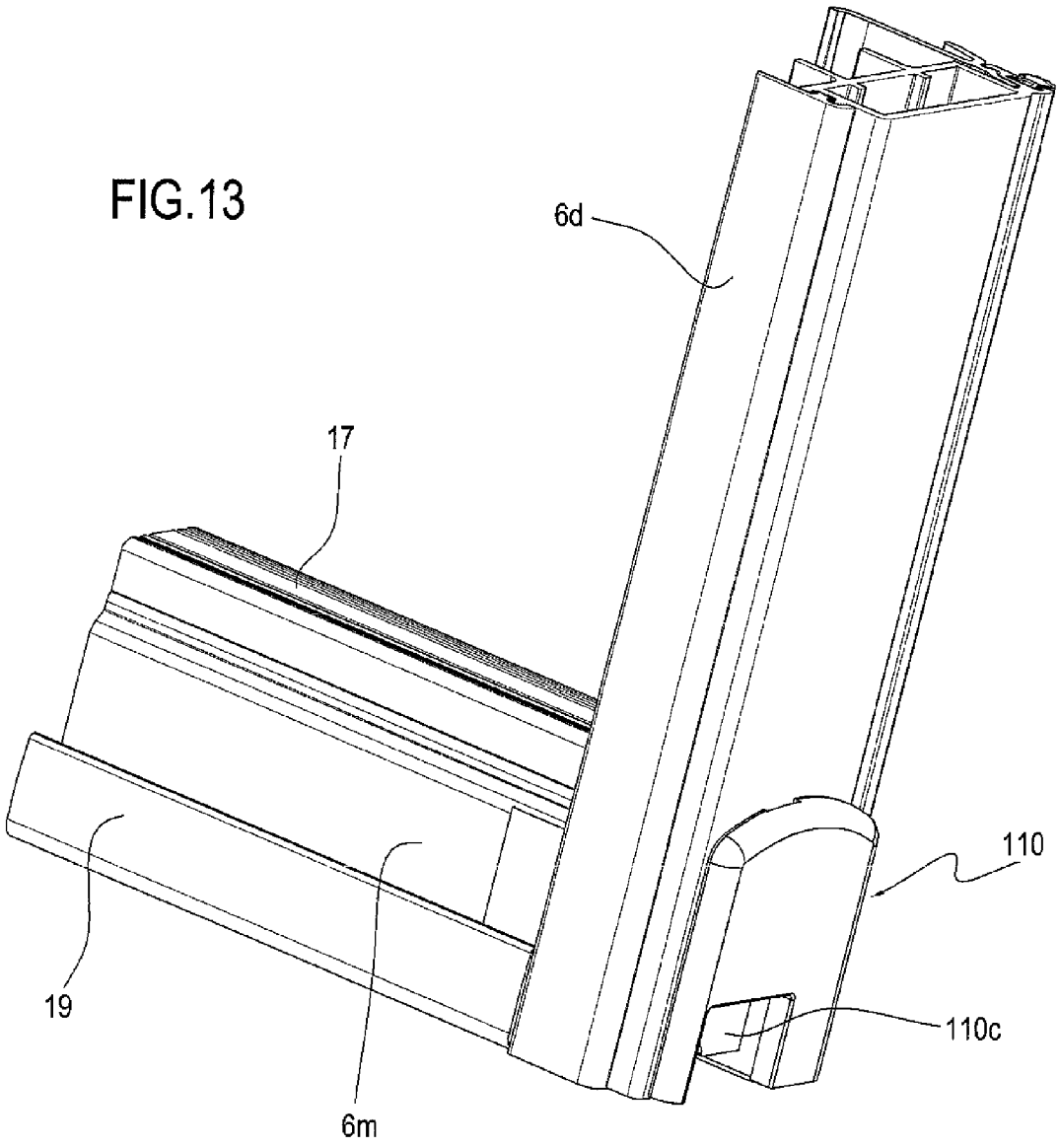
FIGS. 13 and 14 are respectively a perspective view and an exploded perspective view of a portion of the sash according to the invention, in particular a second bottom corner zone of the sash which is respectively assembled and being assembled.
Figure 14:
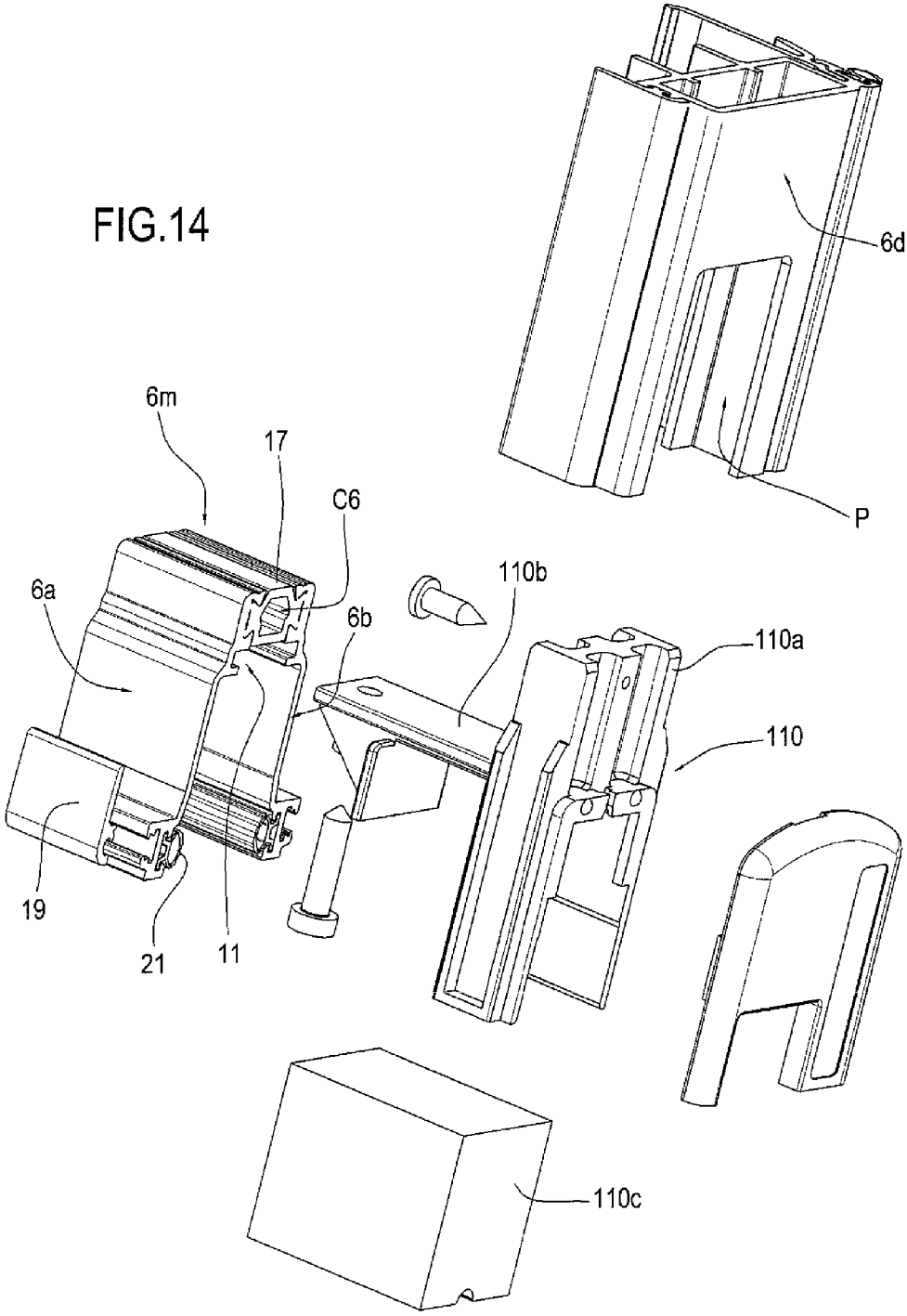
Figure 17:
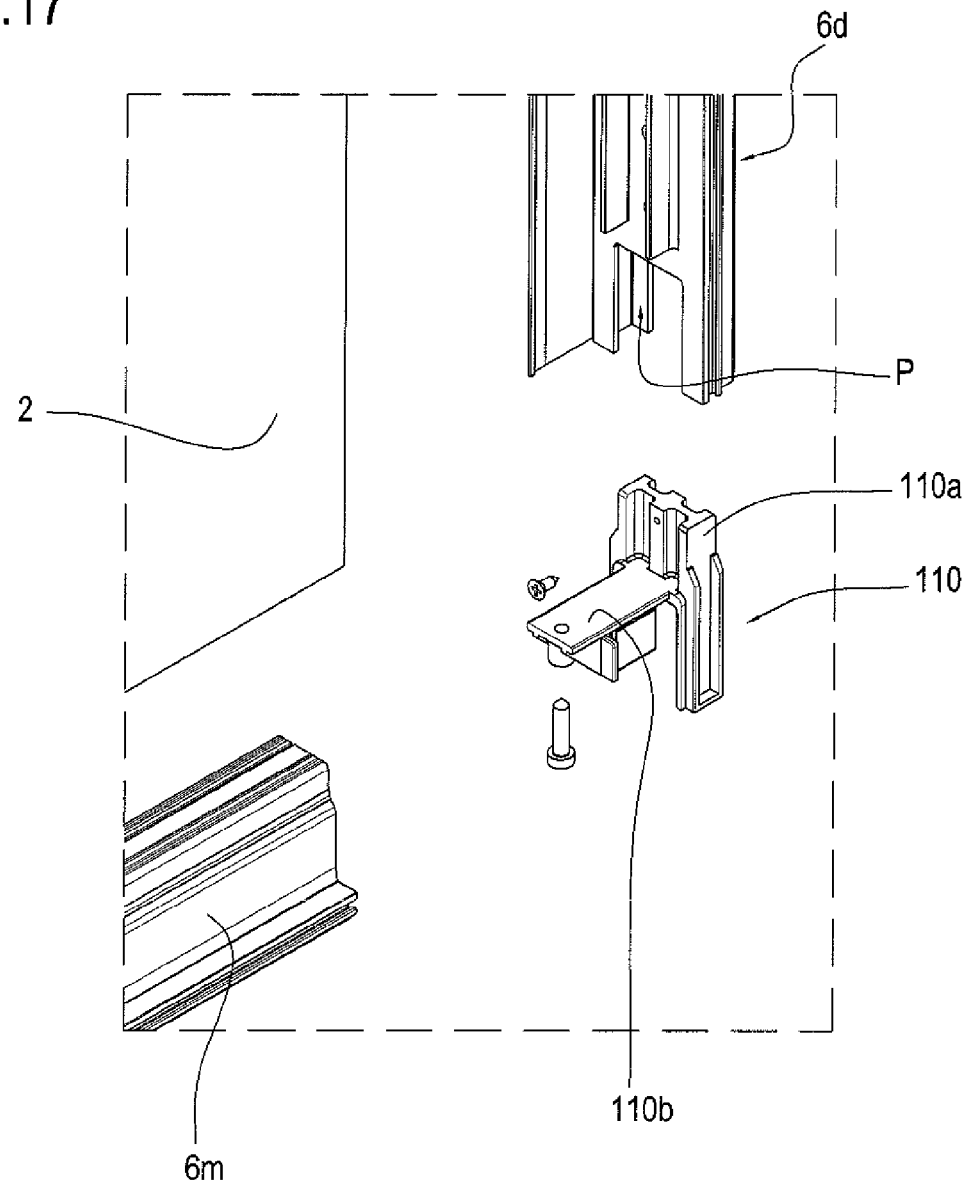
FIG. 17 illustrates an enlarged detail P2 from FIG. 15.

As FIGS. 13, 14 and 17 show, this fourth profile 6*d* forming the sash 100 second (rear) upright comprises a tubular housing P whose respective ends can engage with a part 110*a* of a corresponding angled joining plug 110.

Each of these plugs 110 may be associated by screw elements, with a second part 110*b*, in the corresponding channel 11 present at the respective ends of the two profiles 6 forming the sash 100 crosspieces 6*m* and 105 to obtain corresponding right-angled joints between the three profiles 6*d*, 6*m* and 105. Moreover, the plug 110 may be equipped with a sash 100 recess closing, sealing and damping block 110*c*.

This "inner frame" obtained using the rigid profiles 6 may be hidden so that it cannot be seen from the outside, since along the edges of the glazing panels 3 and 4 receiving the rigid profiles 6 there may be a screening surface 13 whose height H13 is at least equal to the depth of the housing 5.

This screening surface 13 may be obtained directly during production of the main body 1, outside or inside the glazing panels 3, 4.

Examining each rigid profile 6 in more detail, it has at least one bilateral pair of surfaces 14 that can be placed face to face with the inside surface of the glazing panels 3 and 4, and a pair of flanges 15 which can be placed face to face with the edge of the glazing panels 3, 4. Both pairs 14 and 15 are associated with the glazing panels 3 and 4 by the fastening means 7, said surfaces forming the sides 6*a* and 6*b* of each profile 6.

In the embodiment illustrated, the fastening means 7 may be in the form of adhesive, for example structural silicone.

Alternatively (see FIG. 4), each rigid profile 6 may comprise, in addition to the bilateral pair of surfaces 14, a pair of brackets 16 positioned close to the free ends of the surfaces 14 and which can be associated with the latter.

Obviously, the pair of supporting brackets 16 can in turn be placed face to face with the edge of the glazing panels 3 and 4 and can be associated with the glazing panels 3 and 4 by the fastening means 7.

The types and functional features of the rigid profiles 6 may vary according to the technical requirements of the door or window in which the sash 100 must be mounted.

Figure 5:
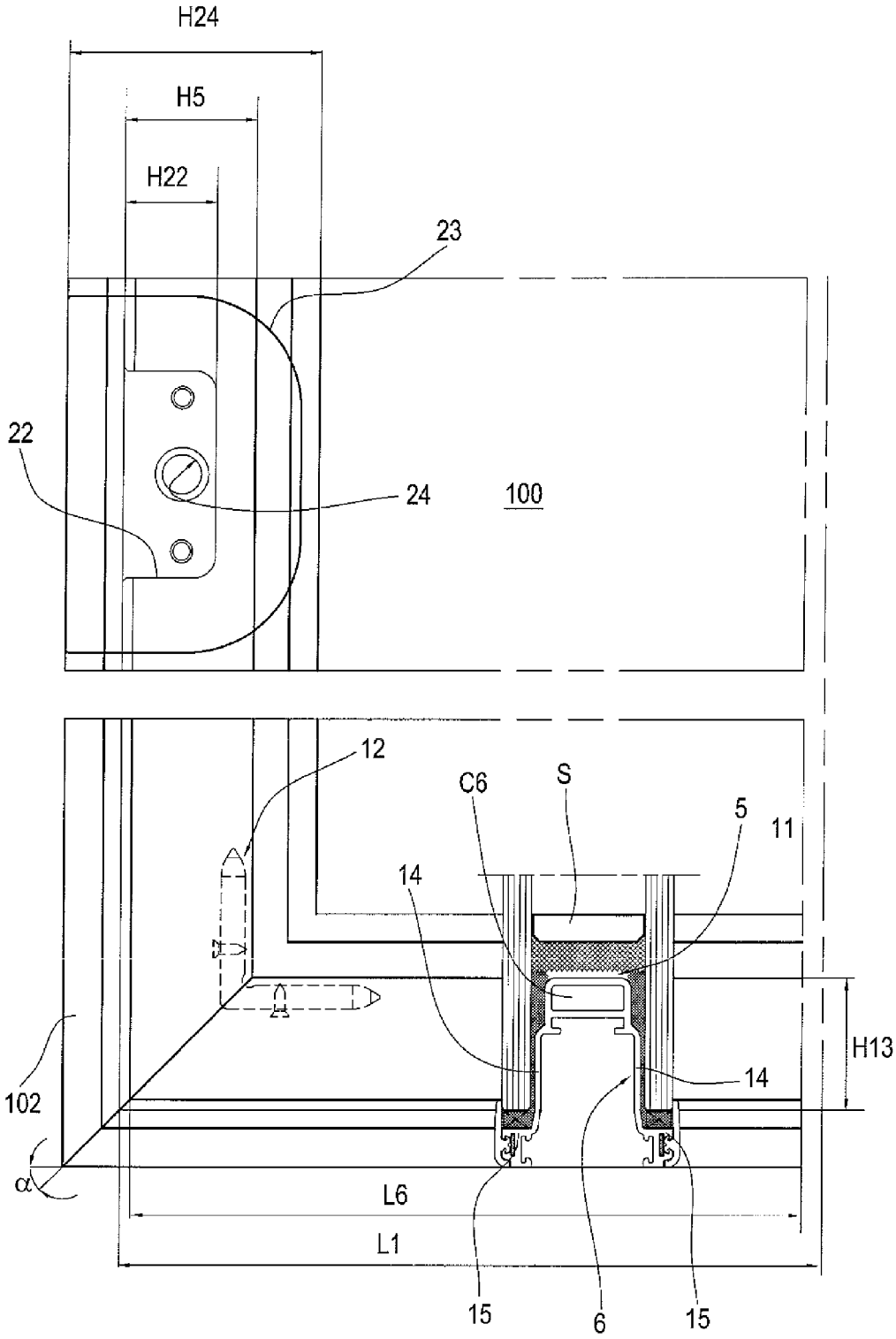
FIG. 5 shows a detail A from FIG. 1 with some parts in cross-section and other parts cut away to better illustrate some technical details.
Figure 6:
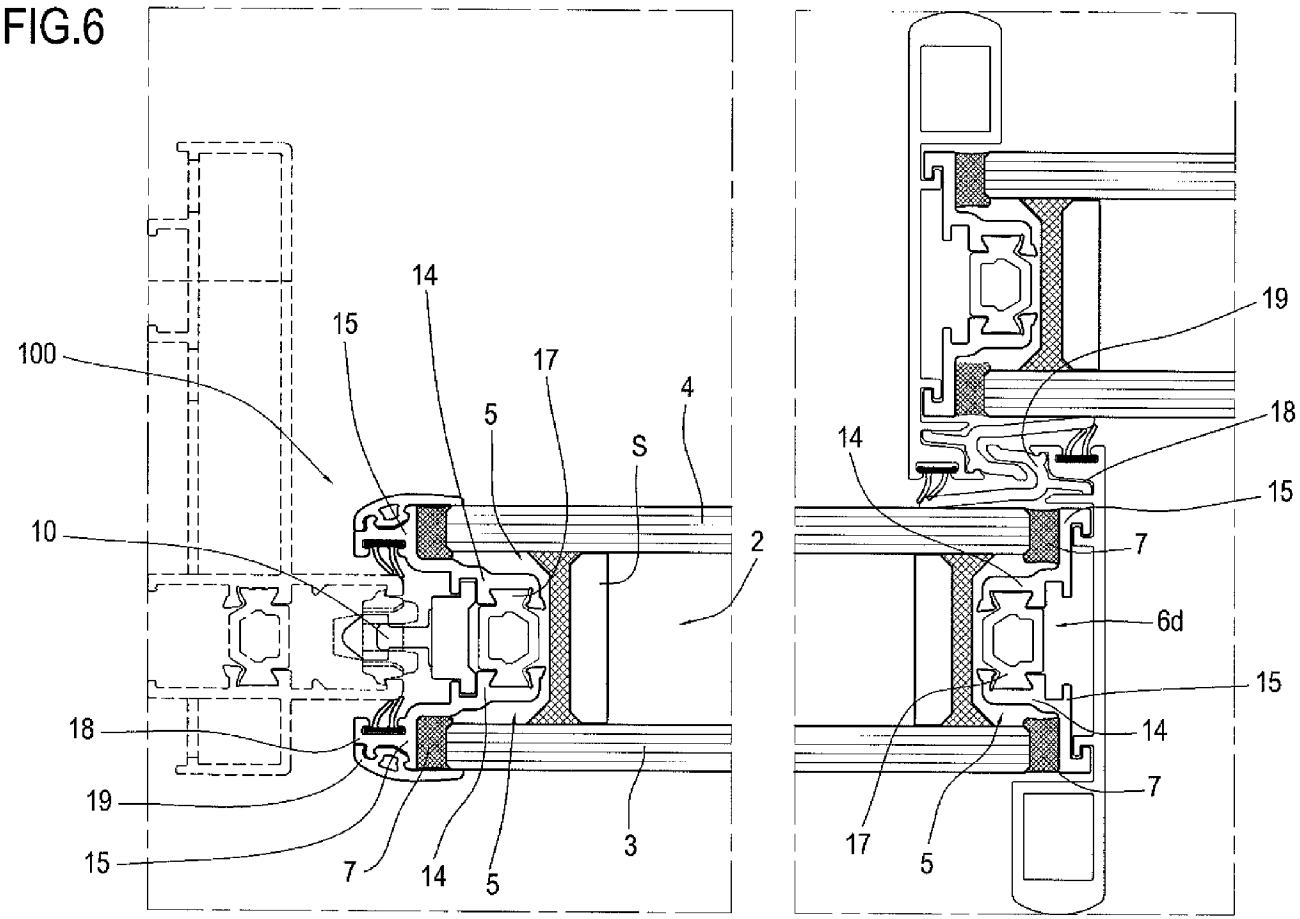
FIG. 6 shows an alternative embodiment of the sash according to a horizontal plane section.
Figure 7:
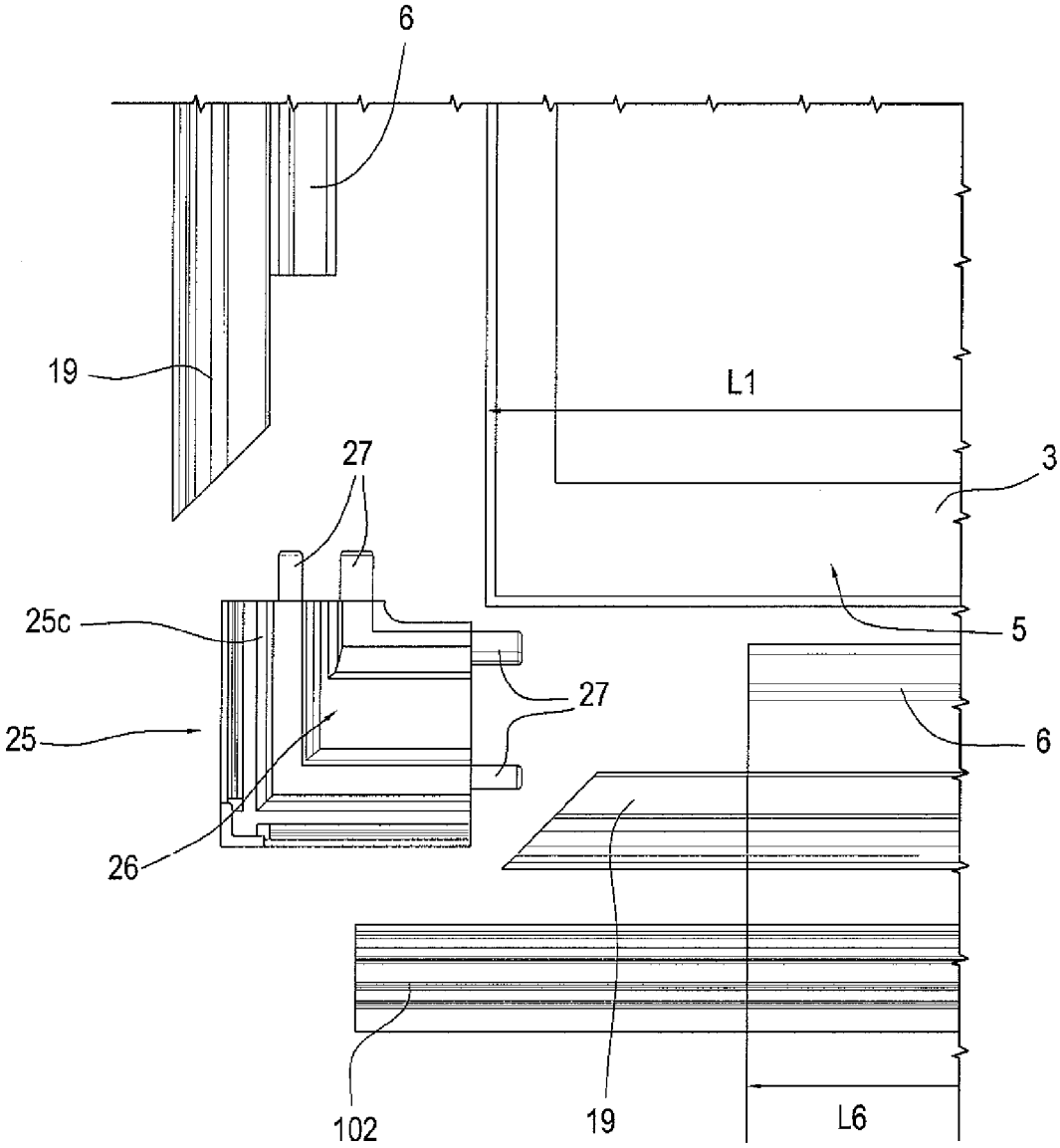
FIG. 7 is an exploded partial side view of an alternative embodiment of the door or window of FIG. 2.
Figure 8:
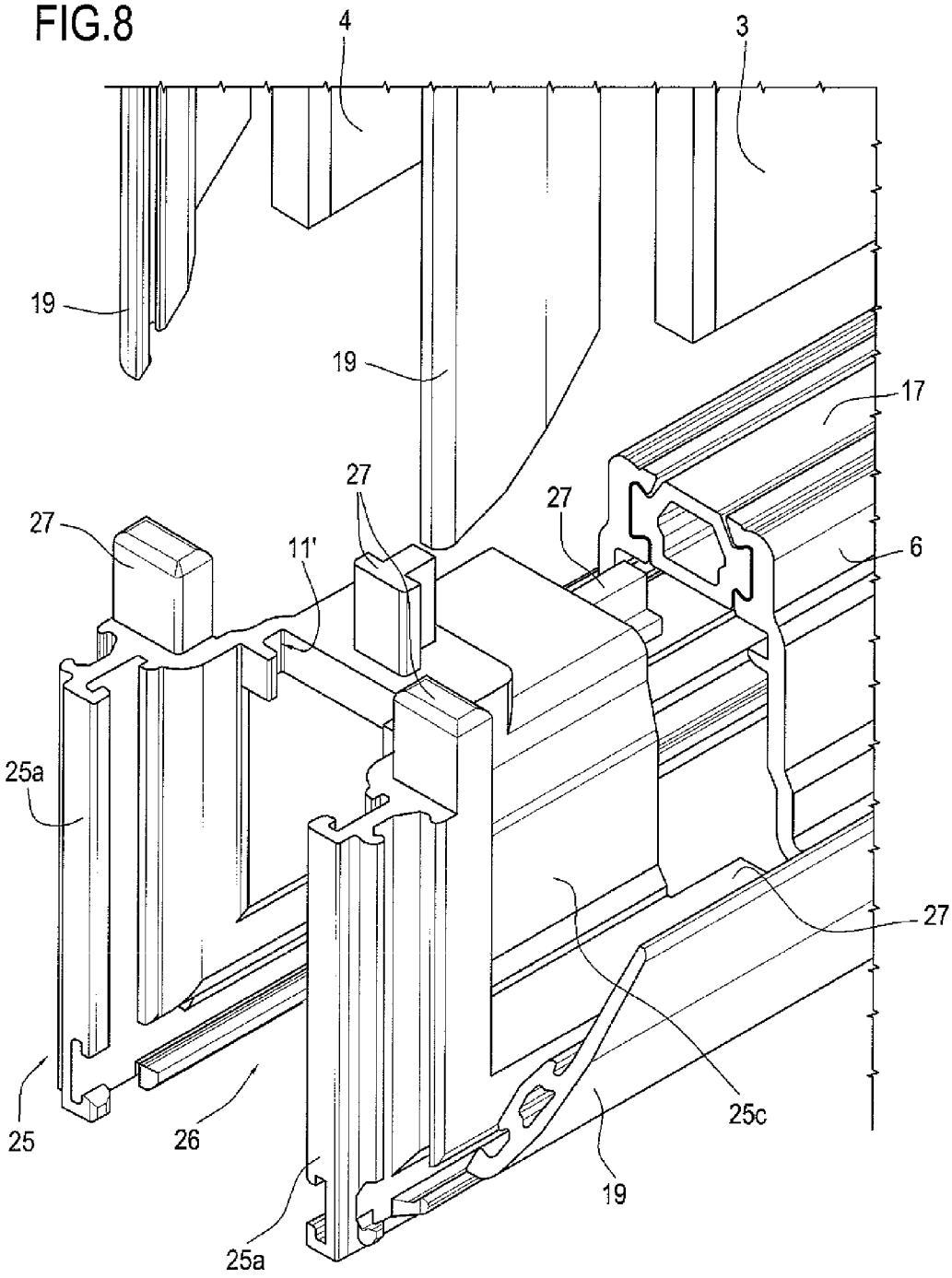
FIG. 8 is an exploded perspective view of the door or window of FIG. 7.
Figure 9:
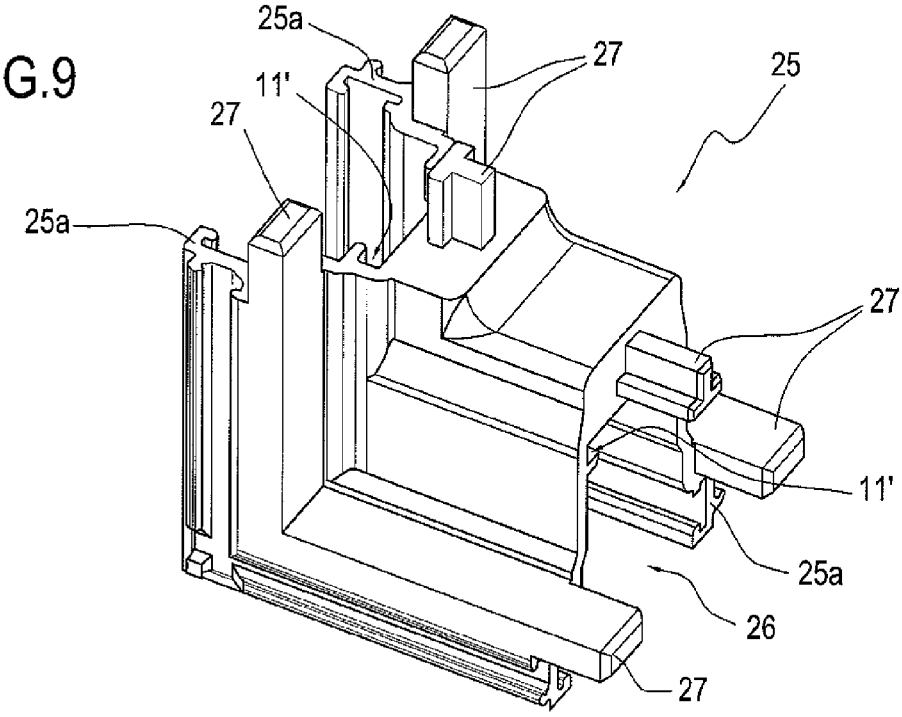
FIG. 9 is a perspective view of a detail relating to the embodiment of FIGS. 7 and 8.

In FIGS. 2, 3 and 5, the section of at least the above-mentioned three rigid profiles 6 may comprise a single body where the housing C6 formed by the tubular element is formed directly by the profile for accommodating operating elements above the channel 11.

In particular, this housing C6 is used for applying the bracket 12 for associating the ends of the profiles 6.

In the case already referred to, see FIGS. 4, 6, 8 10, from 11 to 14 and from 15 to 17, each rigid profile 6 is, in its entirety, a single body, but with an inner zone, close to the insulating chamber 2, comprising the first insulating elements 17 or seals extending along the full length of the rigid profile 6. As already indicated, this architecture, allows improved door or window overall thermal break characteristics.

As already indicated, main and accessory elements are those elements, such as the carriages 9 (visible in FIGS. 4, 15 and 16), closing catches 10 (visible in FIG. 6 and FIG. 15) and obviously the handle M visible in FIGS. 1 and 3.

As is known, said elements are directly or indirectly connected to the rod 8 to allow sash 100 opening-closing and driving operations.

In FIGS. 15 to 17 these elements are illustrated in an assembly diagram for a door or window of the "lift and slide" type, described below.

Returning to the rigid profiles 6, each is bilaterally provided with first protrusions or flanges 18 designed to be coupled to second, external sealing means 19 running parallel with the glazing panels 3, 4, and protruding outside the glazing panels 3, 4.

In addition, the rigid profiles 6 may be provided with second protrusions or flanges 20 designed to be coupled to third sealing means 21 which face the internal space formed by the second protrusions or flanges 20 themselves. This also allows a seal at the sides in contact with the fixed frame 102.

At these second flanges 20 there are flat corner elements 111 which can engage in respective housings in each of the second protrusions or flanges 20, at three corners formed by the respective contiguous profiles 6.

Said corner elements 111 are positioned on opposite sides of each angled joining element 12, thus allowing both improved alignment of the profiles during assembly and a better thermal seal at the corner of the sash 100.

As shown in FIG. 5, the main body 1 has a recess 22 on at least one edge of one of the glazing panels 3, 4 on one side which, in use, defines an upright.

A cover plate 23 can be fitted to the recess 22, said plate being equipped with at least one through hole 24 for stably housing the control handle M that can be connected to the operating and/or drive means 8, 9, 10 present in the respective rigid profile 6.

The size of the plate 23 is greater than the size of the recess 22 so that the plate can be associated with the glazing panel 3 or 4 using structural silicone or another adhesive.

In addition, the plate 23 may be provided with two or more different housings on its surface depending on the type of handle M to be applied (traditional handle, Cremone bolt, presence of opening for key lock barrel visible in FIG. 15, etc.).

As is also clearly visible in FIG. 5, the recess 22 has a depth H22, preferably less than the depth H5 of the perimetric housing 5 of the main body 1.

FIGS. 7 to 10 show an alternative embodiment of the sash 100 according to the invention.

In this embodiment there is a corner joining and closing element 25 which can be associated at each corner formed by the main body 1.

Each of these corner elements 25 is provided with at least one groove 26 for connecting the accessory zone present in the contiguous rigid profiles 6.

Use of these corner elements 25 ensures that the length L6 of each rigid profile 6 is less than the total length L1 of the respective side of the main body 1.

Located in the free zone of the main body 1 housing 5, at each end of the side, there is a corner element 25, defining a dimension LT substantially equal to the length L1 of the side of the main body 1.

To maintain a good seal, in this embodiment the second, external sealing means 19 extend beyond the respective ends of the rigid profiles 6 in such a way that they can be fitted to respective housings or flanges 25*a* on the corner joining elements 25.

FIGS. 7 to 10 also show how each corner element 25 comprises:

- a right-angled outside element 25*c;*
- a plurality of extensions 27, protruding from the outside element 25*c* along the respective joining heads and designed to be coupled to one of the rigid profiles 6;
- the inside connecting groove 26 also forming a channel 11' for the passage of connecting and transmission elements for the operating and/or drive means 8, 9, 10 (elements of the known type and not illustrated);
- at least the above-mentioned bilateral pair of external flanges 25*a* for coupling to the second, external sealing means 19 protruding from the rigid profiles 6.

Figure 10:
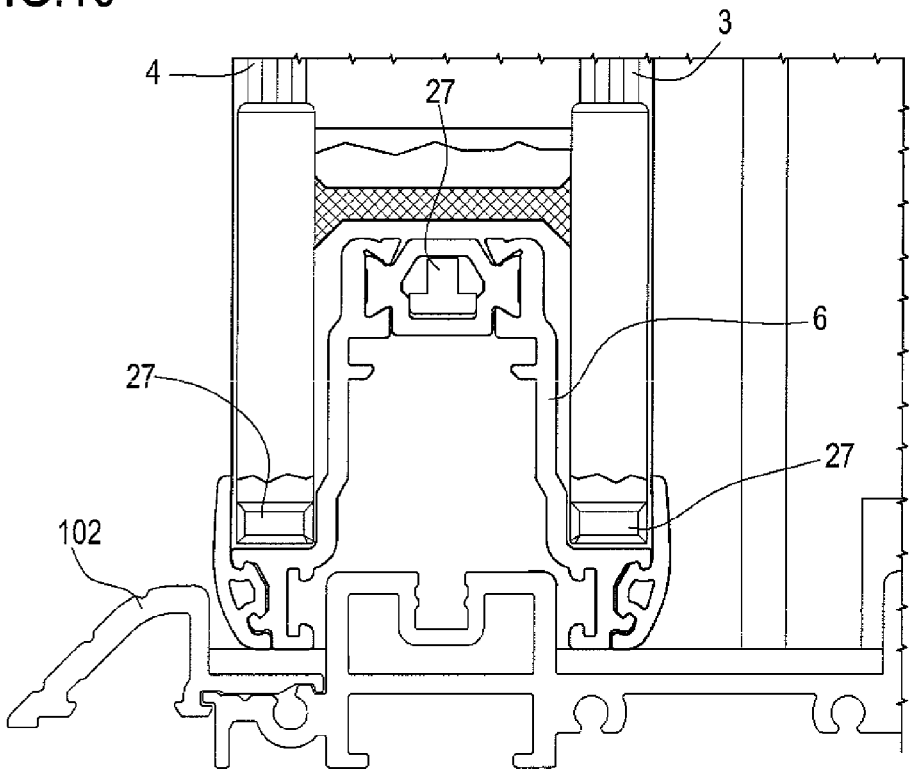
FIG. 10 is a front view of the door or window of FIGS. 7 and 8 with some parts cut away in order to better illustrate some technical details.

In particular, in this case there are three extensions 27 which, in use, are positioned: two at the flanges 15 or 16 of the respective rigid profile 6, and in contact both with the flanges and with the joining zone between the flanges and the edge of the glazing panels 3 and 4; the third extension, in contrast being central in the embodiment in FIG. 10 and engaging in the first insulating element 17, that is to say, in its tubular housing C6.

Obviously, in the embodiment illustrated in FIG. 2, the third extension 27 (having the shape of an inverted "T") would couple to the housing C6 formed, in this case, by the profile 6 itself.

In this case, the corner elements 25 may be associated by adhesive or structural silicone to stabilise the join.

Therefore, a sash structured in this way is assembled starting with a main body 1 provided with the two glazing panels 3 and 4 with the respective insulating chamber 2, housing 5, screening edges 13, and at least one recess 22.

The required rigid profiles 6 are then applied in the housing 5 of the main body 1 and stably joined by means of the elements described above.

At this point, depending on the door or window fitter's requirements, the necessary accessories are applied in the profiles.

As shown in FIGS. 15 to 17, a lift and slide type sash may be accessorized as follows.

Stretches of rod 8 accommodated in the channel 11 along the three profiles 6*m*, 103 and 105, which allow connection of the various operating and sliding elements.

A handle operating unit 120 designed to make the stretches of rod 8 slide in both directions on command when the handle M is operated.

Front closing catches 121 positioned along the front upright 103.

Corner drives 122 at the corners formed by the upright 103 and by the crosspieces 6*m* and 105.

Anti-lifting plugs 123 along the top crosspiece 105.

The carriages 9 connected to the channel 11 along the bottom crosspiece 6*m* and connected to each other by stretches of rod 8 to allow, on command when the handle M is operated, sash 100 lifting for opening and lowering for closing.

Once fully assembled, the sash can be delivered to the door or window fitter who then simply has to mount the fixed frame in the room where it will be located and insert the mobile frame already equipped with all of the elements, for example as described above.

Therefore, a sliding sash structured in this way fulfils the preset aims thanks to the presence of a main body equipped with a perimetric housing which avoids the need for an external supporting frame, a sort of "self-supporting" double-glazing unit thanks to the application of the perimetric rigid profiles.

The all-glass structure, with the exception of the screening edges, allows significant advantages:

- reduction of sash overall weight;
- reduction of the time needed to accessorize the sash, thanks to the elimination of many machining operations such as cutting, boring, slotting, etc., thanks to the "open" configuration of the rigid profiles;
- security seal similar to that of conventional sashes thanks to the presence of standard types of accessories which continue to guarantee high level reliability;
- high aesthetic standard thanks to the increased overall glazing surface area;
- improved thermal performance due, in particular, to the extension of the insulating chamber compared with sashes having a traditional frame.

The invention described above is susceptible of industrial application and may be modified and adapted in several ways without thereby departing from the scope of the inventive concept. Moreover, all the details of the invention may be substituted by technically equivalent elements.

The invention claimed is:

1. A sash for a sliding door or a sliding window, the sash comprising:

- a main body (1) comprising an insulating chamber (2) located between a pair of glazing panels (3, 4), each glazing panel having, in use, a vertical dimension and a horizontal dimension, the vertical and horizontal dimensions of the glazing panels being larger than the corresponding dimensions of the chamber (2) so as to form a perimetric housing (5) which is open towards an outside;
- three rigid profiles (6) forming a frame inside three respective sides of the main body (1), the three rigid profiles (6)

being accommodated stably in the housing (5); the three rigid profiles (6) forming an accessory zone which is open towards the outside;

each of the three rigid profiles (6) being made up of three parts, of which two are sides (6*a*, 6*b*) whose geometry assists in forming the accessory zone, and of which one is a central head portion comprising a first sealing insulating element (17) that is bilaterally associated with the two sides (6*a*, 6*b*) and that forms an innermost surface in the housing (5);

each of the three rigid profiles (6) forming at least one channel (11) in use accommodating at least one operating rod (8) for operating a main means (9) and an accessory means (10); each channel (11) extending parallel with and adjacent to the corresponding first sealing insulating element (17) and along a full length of the channel's corresponding rigid profile (6);

a first rigid profile (6*m*) of the three rigid profiles forming a sash bottom crosspiece (6*m*) which accommodates at least one pair of sliding carriages (9) which are partly inserted in the respective channel (11) of the first rigid profile (6*m*) and which can be connected to the respective operating rod (8), thus in use slidably supporting the main body (1);

the three rigid profiles (6) forming, together with the housing (5), an upright (103) and two crosspieces (6*m*, 105) of the sash (100), each of the three rigid profiles having at least one contiguous end shaped so that said end is angled, allowing the ends of the rigid profiles to be joined and to form a continuous cover for corners of the frame; the ends of the rigid profiles (6) being joined by respective angled elements (12), each angled element (12) being associated with corresponding innermost surfaces of its respective rigid profiles (6) so that the channels (11) define a single channel that runs uninterruptedly along the three sides of the main body (1).

2. The sash according to claim 1, characterized in that the full length (L6) of each rigid profile (6) is substantially equal to a total length (L1) of a respective side of the main body (1).

3. The sash according to claim 1, characterized in that each contiguous end of the three rigid profiles (6) is set at an angle ($\alpha$) equal to 45° so as to obtain an angled plane for contact with the contiguous angled plane of the corresponding rigid profile (6) and, in use, to form a right angle of the frame.

4. The sash according to claim 1, characterized in that each first sealing insulating element (17) of each rigid profile (6) comprises a central tubular housing (C6) which can accommodate, in use, the angled element (12) used to join the rigid profiles (6); there being the possibility of associating the angled element (12) with the first sealing insulating elements (17).

5. The sash according to claim 1, characterized in that a fourth rigid profile (6*d*) forming a sash (100) second upright comprises a tubular housing (P) whose respective ends can engage with a part (110*a*) of a corresponding angled joining plug (110); there being the possibility of associating a second part (110*b*) of each angled joining plug (110) in the corresponding channel (11) present at the respective ends of the two rigid profiles (6) forming the sash (100) crosspieces (6*m*, 105) to obtain corresponding right-angled joints between the three rigid profiles (6*d*, 6*m*, 105).

6. The sash according to claim 1, characterized in that the full length (L6) of each rigid profile (6) is less than a total length (L1) of the corresponding side of the main body (1), thus forming a free zone in the perimetric housing (5); there being the possibility of associating, in the free zone, at each corner formed by the main body (1), a corner joining and closing element (25) which can be associated with the two contiguous rigid profiles (6) at the corresponding corner, so as to obtain a dimension (LT) substantially equal to the total length (L1) of the corresponding sides of the main body (1) and to form a single frame along a perimeter of the sash (100).

7. The sash according to claim 6, characterized in that each corner joining and closing element (25), which can be associated at each corner formed by the main body (1), is provided with at least one corner groove (26) for connecting the accessory zone of the contiguous rigid profiles (6) that is equipped with accessories, and for connecting at least one channel (11) present on the two contiguous rigid profiles (6).

8. The sash according to claim 7, characterized in that the sash comprises second, external sealing means (19) which extend beyond the respective ends of the rigid profiles (6) in such a way that the second, external sealing means (19) can be fitted to respective housings (25*a*) on the corner joining and closing elements (25).

9. The sash according to claim 6, characterized in that each corner joining and closing element (25) comprises:

a right-angled outside element (25*c*);

a plurality of extensions (27), protruding from the outside element (25*c*) along respective joining heads and designed to be coupled to one of the rigid profiles (6);

an inside connecting groove (26) also forming a channel (11') for a passage of connecting and transmission elements (28) for operating a drive means (8, 9, 10);

at least one bilateral pair of external flanges (25*a*) for coupling to second, external sealing means (19) protruding from the rigid profiles (6).

10. The sash according to claim 1, characterized in that along edges of the glazing panels (3, 4) accommodating the rigid profile (6) there is a screening surface (13) whose height (H13) is at least equal to a depth of the perimetric housing (5).

11. The sash according to claim 1, characterized in that each rigid profile (6) is accommodated stably in the perimetric housing (5) through fastening means (7), wherein each rigid profile (6) has at least one bilateral pair of surfaces (14) that can be placed face to face with an inside surface of the glazing panels (3, 4) and a pair of flanges (15) which can be placed face to face with an edge of the glazing panels (3, 4) and which can be joined by the fastening means (7).

12. The sash according to claim 1, characterized in that each rigid profile (6) is accommodated stably in the perimetric housing (5) through fastening means (7), wherein each rigid profile (6) has at least one bilateral pair of surfaces (14) that can be placed face to face with an inside surface of the glazing panels (3, 4); there being the possibility of associating, near free ends of the surfaces (14), a pair of supporting brackets (16) which can in turn be placed face to face with an edge of the glazing panels (3, 4) and which can be joined by the fastening means (7).

13. The sash according to claim 1, characterized in that each rigid profile (6) is accommodated stably in the perimetric housing (5) through fastening means (7), wherein the fastening means (7) are in the form of adhesive.

14. The sash according to claim 1, characterized in that each rigid profile (6) is bilaterally provided with first protrusions or flanges (18) designed to be coupled to second, external sealing means (19) running parallel with the glazing panels (3, 4) and protruding outside the glazing panels (3, 4).

15. The sash according to claim 1, characterized in that each of the three rigid profiles (6) is provided with second protrusions or flanges (20) designed to be coupled to third sealing means (21) which face an internal space formed by the second protrusions or flanges (20).

16. The sash according to claim 15, characterized in that the sash comprises a flat corner element (111) which can engage in respective housings in each of the second protrusions or flanges (20), at least at three corners formed by the respective contiguous rigid profiles (6) so that two of the corner elements (111) are positioned on opposite sides of each angled element (12), giving the corner greater rigidity and an improved corner thermal seal.

17. The sash according to claim 1, characterized in that the main body (1) has a recess (22) on at least one edge of one of the glazing panels (3, 4) on one side which, in use, defines an upright; the recess (22) being fitted with a cover plate (23) equipped with at least one through hole (24) for stably housing a control element (M) that can be connected to operate a drive means (8, 9, 10) mounted in the respective rigid profile (6).

18. The sash according to claim 17, characterized in that the recess (22) has a depth (H22) which must at least be less than a depth (H5) of the perimetric housing (5) formed on the main body (1).

* * * * *